US005758504A

United States Patent [19]

Abreu et al.

[11] Patent Number: 5,758,504

[45] Date of Patent: Jun. 2, 1998

[54] IMPINGEMENT/EFFUSION COOLED COMBUSTOR LINER

[75] Inventors: Mario E. Abreu, Poway; Virenda M. Sood, Encinitas, both of Calif.

[73] Assignee: Solar Turbines Incorporated, San Diego, Calif.

[21] Appl. No.: 692,142

[22] Filed: Aug. 5, 1996

[51] Int. Cl.[6] ..... F02G 3/00

[52] U.S. Cl. ..... 60/754; 60/39.32; 60/755

[58] Field of Search ..... 60/39.36, 755, 60/757, 39.32, 754; 431/351, 352

[56] References Cited

U.S. PATENT DOCUMENTS

| | | | |
|---|---|---|---|
| 2,919,549 | 1/1960 | Haworth et al. | 60/755 |
| 4,776,172 | 10/1988 | Havercroft | 60/754 |
| 5,398,509 | 3/1995 | North et al. | 60/755 |
| 5,435,139 | 7/1995 | Pidcock et al. | 60/757 |

FOREIGN PATENT DOCUMENTS

| | | | |
|---|---|---|---|
| 2555814 | 6/1996 | Germany | 60/755 |

*Primary Examiner*—Charles G. Freay
*Attorney, Agent, or Firm*—Larry G. Cain

[57] ABSTRACT

Existing combustors have the tendency to emit emissions and require a large quantity of cooling air to retain or extend the life of the components to a reasonable life expectancy. The present combustor reduces the emissions emitted therefrom, requires a reduced quantity of cooling air while resulting in a high heat transfer cooling rate extending the life expectancy of the components. The combustor construction includes an interior liner having a plurality of angled holes extending therethrough arranged in a preestablished pattern defining a centroid and an exterior liner having a plurality of holes extending therethrough at about a 90 degree. At least a portion of the plurality of holes in the exterior liner being radially aligned with the centroid of the plurality of holes in the interior line.

23 Claims, 4 Drawing Sheets

192
162
240
196
90
130
56
86
256
146
238
252
254
250
236
156
50
126
92
142
144
26
88
82
84
80
128
112
124
122
164
170
232
234
222
194
186
190
198
188
140
62
100
102
64
58
226
212
210
186
168
52
44
114
116
224
218
158
184
188
78
152
216
150
178
72
106
46
108
54
176
220
160
182
154
174
172
74
70
48
180
60
66
68
76
110
166
42
40
4
3

IMPINGEMENT/EFFUSION COOLED COMBUSTOR LINER

TECHNICAL FIELDS

This invention relates generally to a gas turbine engine and more particularly to an improved low emission combustor for use with the gas turbine engine.

1. Background Art

High performance gas turbine engines require increased firing temperatures and increased compressor pressures. Coolant from the compressor section is directed through cooling passages in various components to enhance reliability and cycle life of individual components within the engine. For example, to improve fuel economy characteristics, engines are being operated at higher temperatures than the material physical property limits of which the engine components are constructed. These higher temperatures, if not compensated for, oxidize engine components, distort engine components and decrease component life. Cooling passages are used to direct a flow of air to such engine components to reduce the high temperature of the components and prolong component life by limiting the temperature to a level which is consistent with material properties of such components.

However, as the amount of coolant air is increased to cool the engine components the amount of air available for the combustion chamber is decreased. Thus, systems and methods of increasing cooling efficiency and reducing the amount of coolant used to cool the engine components must be utilized.

The present invention is directed to overcome one or more of the problems as set forth above.

2. Disclosure of the Invention

In one aspect of the present invention, a combustor is comprised of an interior liner defining an inlet end portion and an outlet end portion being spaced apart by an axial portion. The interior liner defines a combustion side and a cooling side having a plurality of effusion holes defined therein extending between the combustion side and the cooling side. The plurality of effusion holes are formed in a preestablished pattern defining a centroid. The combustor further includes an exterior liner defining an inlet end portion and an outlet end portion being spaced apart by an axial portion. The exterior liner defines a first surface and a second surface having a plurality of impingement holes defined therein extending between the first surface and the second surface at an angle of about 90 degrees. The plurality of impingement holes are formed in a preestablished pattern and at least a portion of the plurality of impingement holes in the exterior liner are positioned in radial alignment with the centroid of the preestablished pattern of the plurality of effusion holes in the interior liner.

BEST MODE FOR CARRYING OUT THE INVENTION

Figure 1:
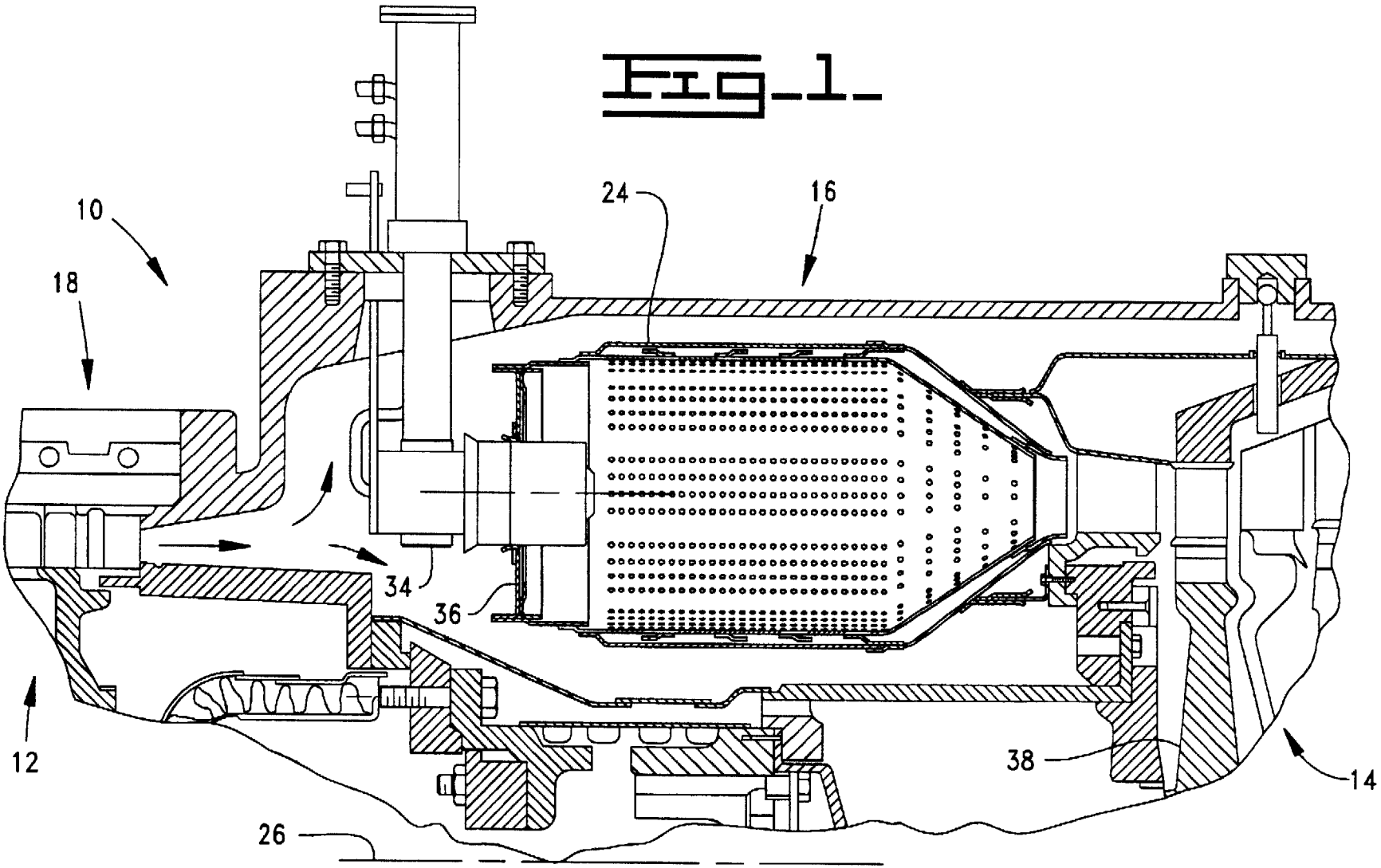
FIG. 1 is a partially sectioned partial view of a gas turbine engine embodying the present invention.

Referring to FIG. 1, a gas turbine engine 10 is shown but not in its entirety. The gas turbine engine 10 includes an air flow delivery system 12 for providing combustion air and for providing cooling air for cooling components of the engine 10. The engine 10 includes a turbine section 14, a combustor section 16 and a compressor section 18. The combustor section 16 and the compressor section 18 are operatively connected to the turbine section 14. In this application the combustor section 16 includes an annular combustion chamber 24 being positioned about a central axis 26 of the gas turbine engine 10. As an alternative this could include a plurality of can combustors without changing the essence of the invention. The annular combustion chamber 24 is operative positioned between the compressor section 18 and the turbine section 14. A plurality of fuel nozzles 34 (one shown) are positioned in an inlet end portion 36 of the annular combustion chamber 24. The turbine section 14 includes a first stage turbine 38 being centered about the central axis 26.

Figure 2:
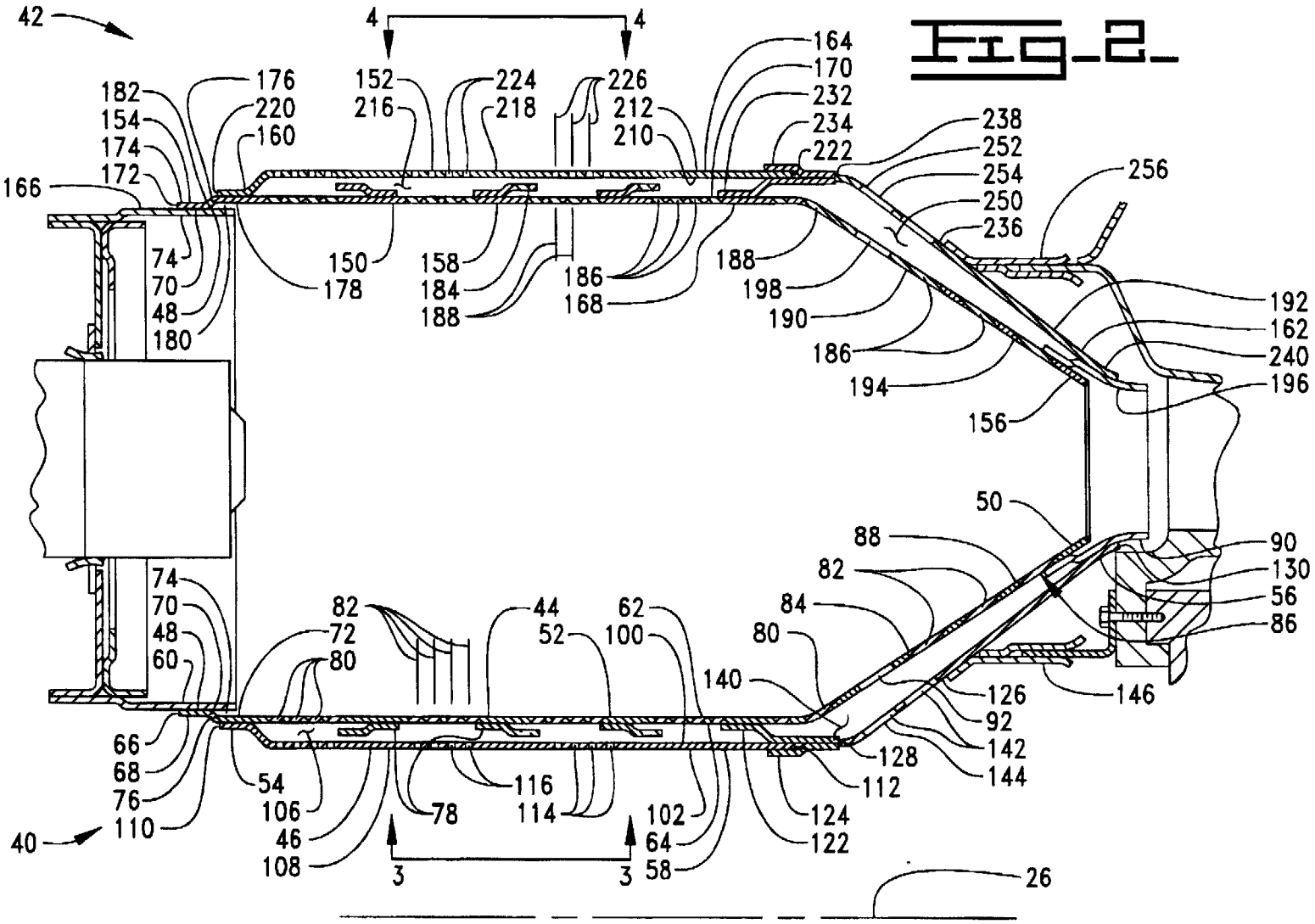
FIG. 2 is an enlarged sectional side view of a combustion liner embodying the present invention.

As best shown in FIG. 2, the annular combustion chamber 24 is enclosed by an inner liner portion 40 and an outer liner portion 42 being spaced apart a preestablished distance. The inner liner portion 40 is spaced from the central axis 26 a preestablished distance and has a generally cylindrical configuration. The inner liner portion 40 includes an outer thin sheet metal annularly shaped skin member or interior liner 44 and an inner thin sheet metal annularly shaped skin member or exterior liner 46 being generally spaced one from the other a preestablished distance which in this application ranges from about 6 mm to about 15 mm. The outer skin members 44 has an inlet end portion 48 and an outlet end portion 50 axially spaced one from the other by an axial portion 52. And, the inner skin member 46 has an inlet end portion 54 and an outlet end portion 56 axially spaced one from the other by an axial portion 58.

Figure 3:
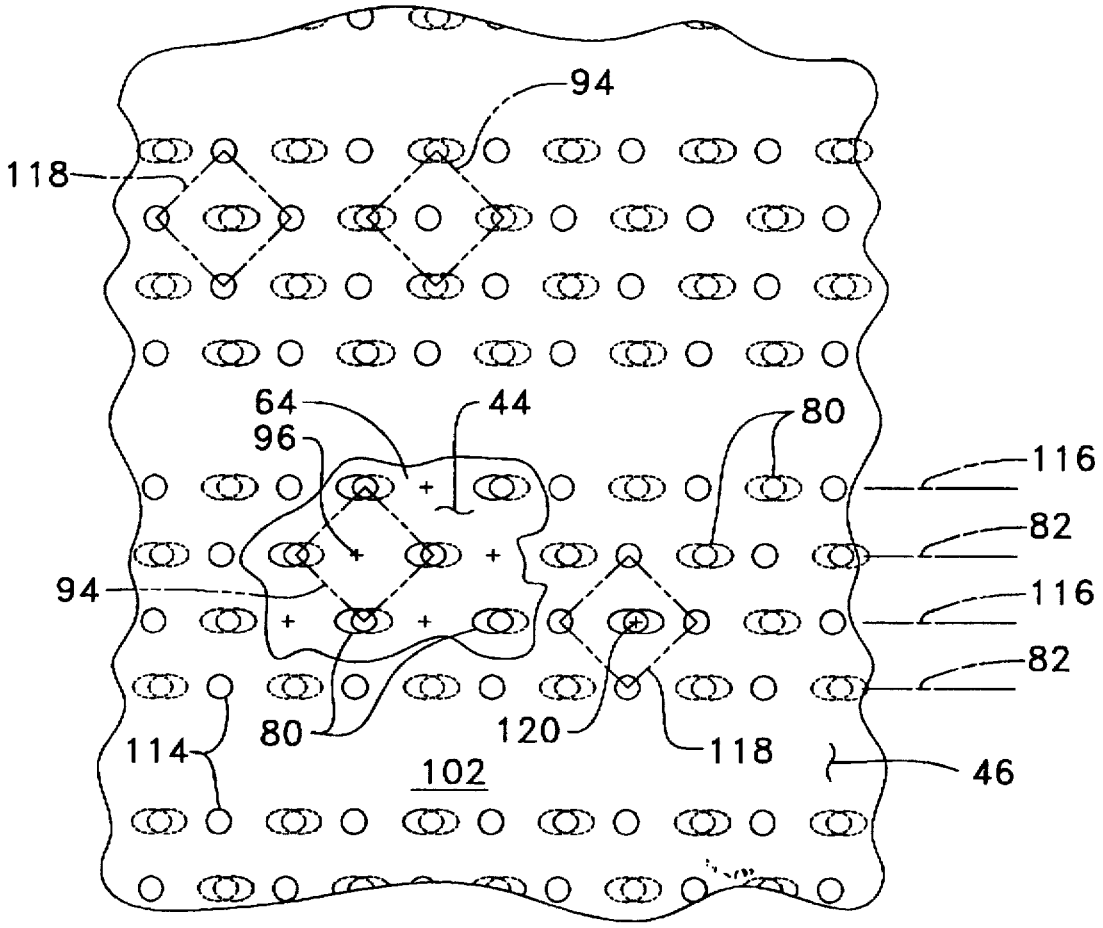
FIG. 3 is an enlarged sectional view taken along line 3 of FIG. 2.

As further shown in FIG. 2, the inner liner portion 40 further includes an inner inlet member 60 positioned at the inlet end portion 48 of the outer liner portion 44 being in communication with the compressor section 18 and being supported within the gas turbine engine 10 in a conventional manner. The outer skin member 44 defines a combustion side 62 and a cooling side 64 and has a preestablished configuration including a first end 66 being formed at the inlet end portion 48 and being attached to the inlet member 60. The inlet end portion 48 includes an axial portion 68 being connected to the inlet member 60 and a radial portion 70 extending from the axial portion 68. A straight portion 72 is connected to the radial portion 70 and forms a portion of the axial portion 52. An annular gallery 74 is formed between a portion of the straight portion 72, the radial portion 70 and a portion of the inlet member 60. A plurality of passages 76 extend through the radial portion 70 and communicate a flow of cooling air from the air flow delivery system 12 to the annular gallery 74. Spaced along the straight portion 72 at a preestablished distance and attached to the cooling side 64 is a plurality of stiffener members 78. A plurality of effusion cooling holes 80 are positioned in rows 82 along the straight portion 72. The rows 82 of the plurality of effusion cooling holes 80 are positioned axially along the straight portion 72 being spaced apart at a preestablished distance. The cooling holes 80 are spaced circumferentially along the rows 82 at preestablished intervals. The plurality of effusion cooling holes 80 are positioned in the outer skin member 44 at an angle of about 15 to 30 degrees and extend from the cooling side 64 through to the combustion side 62 and angle from the inlet end portion 48 toward the outlet end portion 50. A frustoconical or tapered portion 84 is connected to the straight portion 72 and forms the outlet end portion 50. The frustoconical portion 84 defines a cooling side 86 and a combustion side 88. Additional ones of the plurality of effusion cooling holes 80 are positioned in additional rows 82 along the frustoconical portion 84 and extend between the cooling side 86 and the combustion side 88 at an angle and angle from the inlet end portion 48 toward the outlet end portion 50. A transition portion 90 is connected to the frustoconical portion 84 and communicates with the turbine section 14. Further positioned in the frustoconical portion 84 is at least a row of dilution holes 92. The dilution hole 92 extends from the cooling side 86 through to the combustion hot side 88 at about a 90 degree angle. As best shown in FIG. 3, the spacing of the rows 82 and the positioning of the plurality of effusing cooling holes 80 along each of the rows 82 are arranged in a preestablished pattern 94 being generally defined as a diamond configuration having a centroid 96.

As further shown in FIG. 2, the inner skin member 46 of the inner liner portion 40 defines a first surface 100 being positioned adjacent the cooling side 64,86 and a second surface 102 being opposite the first surface 100. The inlet end portion 54 of the inner skin member 46 is attached to the straight portion 72 of the outer skin member 44 and has a configuration which spaces the outer and inner skin members 44,46 apart forming a first cooling cavity 106 therebetween. A straight portion 108 of the inner skin member 46 has a first end 110 and a second end 112. The first end 110 is connected to the first end portion 54 of the inner skin member 46 and has the first surface 100 spaced from the cooling side 64 a preestablished distance being generally equal along the entire axial distance of the straight portion 108 and forms a portion of the axial portion 52. The first cavity 106 is generally uniformly spaced apart a preestablished distance along an axial distance of the first cavity 106. The axial distance of the first cavity 106 being generally equal to the axial distance of the straight portion 108. A plurality of impingement holes 114 are positioned in a row 116 along the straight portion 108. The rows 116 of the plurality of impingement holes 114 are positioned axially along the straight portion 108 being spaced apart at a preestablished distance. The impingement holes 114 are spaced circumferentially along the rows 116 at preestablished intervals. The impingement holes 114 are positioned at generally a 90 degree angle to the first and second surfaces 100,102 of the inner skin member 46. The flow of cooling air from the air flow delivery system 12 is communicated to the first cooling cavity 106 through the plurality of impingement cooling holes 114. As best shown in FIG. 3, the spacing of the rows 116 and the positioning of the plurality of impingement holes 114 along each of the rows 116 are arranged in a preestablished pattern 118 being generally defined as a diamond configuration having a centroid 120. The plurality of holes 114 in the straight portion 108 of the inner member 46 are positioned in radial alignment with the centroid 96 of the preestablished pattern 94 of the plurality of holes 80 in the outer member 44. At the second end 112 of the straight portion 108, a plurality of spacer members 122 are intermittently positioned between the cooling side 64 of the outer skin member 44 and the first surface 100 of the inner skin member 46. Each of the spacer members 122 is attached to an annular member 124 in which the second end 112 of the straight portion 108 is positioned therein. Connected to the spacer members 122 and the annular sliding member 124 is an annular arcuate or tapered portion 126 at a first end 128 and has a second end 130 corresponding to the outlet end portion 56 connected to the transition portion 90. The annular arcuate portion 126 is spaced from the frustoconical portion 84 and forms a second cooling cavity 140. The spacing of the annular arcuate portion 126 from the frustoconical portion 84, in this application, is not necessarily evenly spaced along the second cooling cavity 140 between the first end 128 and the second end 130 of the annular arcuate portion 126. In this application, the spaced apart distance of the second cavity 140 is of a non-uniform spacing and the distance is smaller adjacent the second end 130. A plurality of non metering airflow inlet holes 142 are positioned in rows 144 and along the circumference of the rows 144 at predetermined locations. The plurality of non metering airflow inlet holes 142 are located closer to the first end 128 than to the second end 130 of the frustoconical portion 84. The flew of cooling air from the air flow delivery system 12 is communicated to the second cooling cavity 140 through the plurality of non metering airflow inlet holes 142. But, cooling airflow from the flow delivery system 12 is delivered to the first cooling cavity 106 and to the areas between the plurality of spacer members 122 by the impingement cooling holes 114. A support member 146 is attached to the annular arcuate portion 126 and supports the outlet end portion 50 of the outer skin member 44 by way of the transition portion 90 and the outlet end portion 56 of the inner skin member 46 in a conventional manner.

The outer liner portion 42 is spaced from the central axis 26 a preestablished distance, which in this application is a greater distance than the preestablished distance from the central axis 26 than that of the inner liner portion 40, and has a generally cylindrical configuration. The outer liner portion 42 includes an inner thin sheet metal annularly shaped skin member or interior liner 150 and an outer thin sheet metal annularly shaped skin member or exterior liner 152 being generally spaced one from the other a preestablished distance which in this application ranges from about 6 mm and about 15 mm. The inner skin member 150 has an inlet end portion 154 and an outlet end portion 156 axially spaced one from the other by an axial portion 158. And, the outer skin member 152 has an inlet end portion 160 and an outlet end portion 162 axially spaced one from the other by an axial portion 164.

Figure 4:
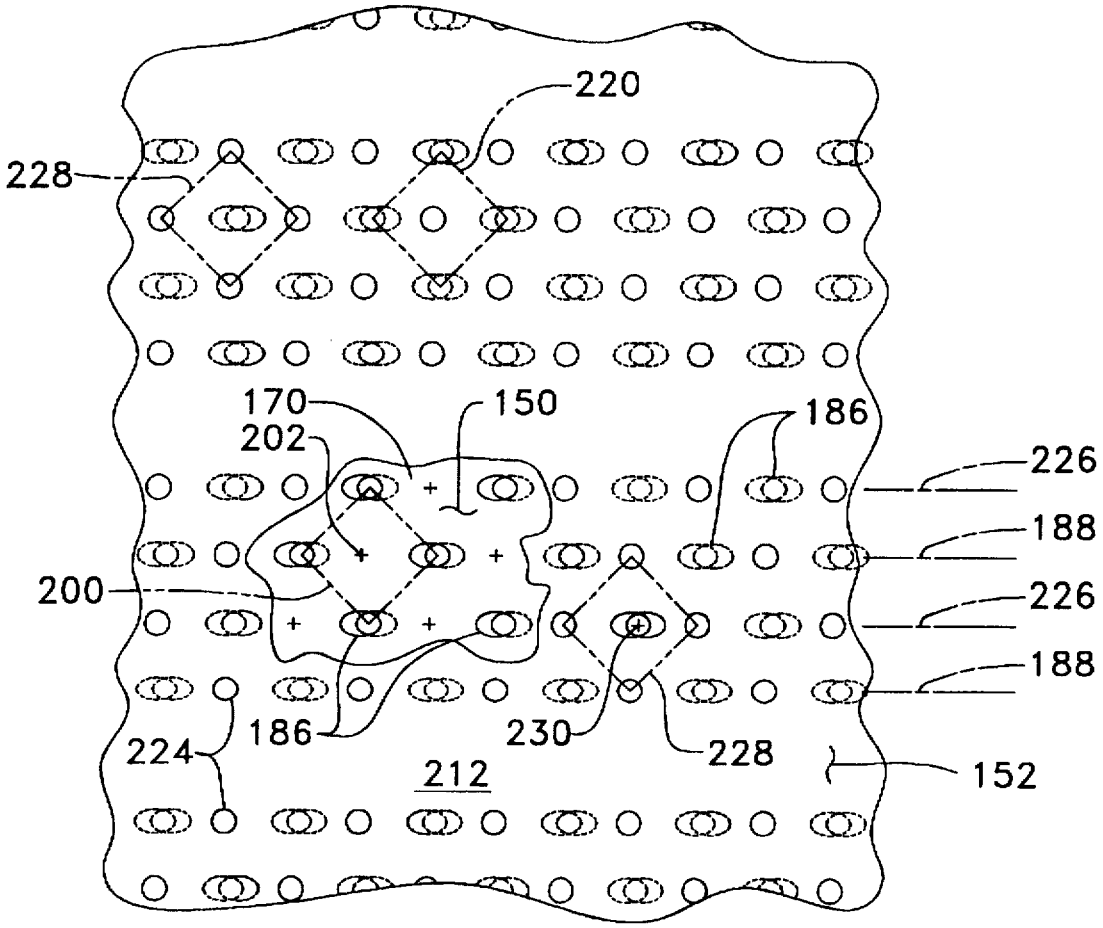
FIG. 4 is an enlarged sectional view taken along line 4 of FIG. 2.

The outer liner portion 42 further includes an outer inlet member 166 positioned at the inlet end portion 154 of the inner skin member 150 being in communication with the compressor section 18 and being supported within the gas turbine engine 10 in a conventional manner. The inner skin member 150 defines a combustion side 168 and a cooling side 170 and has a preestablished configuration including a first end 172 being formed at the inlet end portion 154 and being attached to the outer inlet member 166. The inlet end portion 154 includes an axial portion 174 being connected to the outer inlet member 166 and a radial portion 176 extending from the axial portion 174. A straight portion 178 is connected to the radial portion 176 and forms a portion of the axial portion 158. An annular gallery 180 is formed between a portion of the straight portion 178, the radial portion 176 and a portion of the outer inlet member 166. A plurality of passages 182 extend through the radial portion 176 and communicate a flow of cooling air from the air flow delivery system 12 to the annular gallery 180. Spaced along the straight portion 178 at a preestablished distance and attached to the cooling side 170 is a plurality of stiffener members 184. A plurality of effusion cooling holes 186 are positioned in rows 188 along the straight portion 178. The rows 188 of the plurality of effusion cooling holes 186 are positioned axially along the straight portion 178 being spaced apart at a preestablished distance. The cooling holes 186 are spaced circumferentially along the rows 188 at preestablished intervals. The plurality of effusion cooling holes 186 are positioned in the inner skin member 150 at an angle of about 15 to 20 degrees and extend from the cooling side 170 through to the combustion side 168 and angle from the inlet end portion 154 toward the outlet end portion 156. An inner conical or tapered portion 190 is connected to the straight portion 178 and forms the outlet end portion 156. The inner conical portion 190 defines a cooling side 192 and a combustion side 194. Additional ones of the plurality of effusion cooling holes 186 are positioned in additional rows 188 along the inner conical portion 190 and extend between the cooling side 192 and the combustion side 194 at an angle and angle from the inlet end portion 154 toward the outlet end portion 156. A transition portion 196 is connected to the inner conical portion 190 and communicates with the turbine section 14. Further positioned in the inner conical portion 190 is at least a row of dilution holes 198. The dilution hole 198 extend from the cooling side 192 through to the combustion side 194 at about a 90 degree. As best shown in FIG. 4, the spacing of the rows 188 and the positioning of the plurality of effusing cooling holes 186 along each of the rows 188 are arranged in a preestablished pattern 200 being generally defined as a diamond configuration having a centroid 202.

The outer skin member 152 of the outer liner portion 42 defines a first surface 210 being positioned adjacent the cooling side 170 and a second surface 212 being opposite the first surface 210. The inlet end portion 160 of the outer skin member 152 is attached to the straight portion 178 of the inner skin member 150 and has a configuration which spaces the inner and outer skin members 150,152 apart forming a first cooling cavity 216 therebetween. A straight portion 218 of the outer skin member 152 has a first end 220 and a second end 222. The first end 220 is connected to the inlet end portion 160 of the inner skin member 150 and has the first surface 210 spaced from the cooling side 192 a preestablished distance being generally equal along the entire axial distance of the straight portion 218 and forms a portion of the axial portion 164. The first cavity 216 being generally uniformly spaced apart a preestablished distance along an axial distance of the first cavity 216. The axial distance of the first cavity 216 being generally equal to the axial distance of the straight portion 218. A plurality of impingement holes 224 are positioned in a row 226 along the straight portion 218. The rows 226 of the plurality of impingement holes 224 are positioned axially along the straight portion 218 being spaced apart at a preestablished distance. The impingement holes 224 are spaced circumferentially along the rows 226 at preestablished intervals. The impingement holes 224 are positioned at generally a 90 degree angle to the first and second surfaces 210,212 of the outer skin member 152. The flow of cooling air from the air flow delivery system 12 is communicated to the first cooling cavity 216 through the plurality of impingement cooling holes 224. As best shown in FIG. 4, the spacing of the rows 226 and the positioning of the plurality of impingement holes 224 along each of the rows 226 are arranged in a preestablished pattern 228 being generally defined as a diamond configuration having a centroid 230. The plurality of holes 224 in straight portion 218 of the outer member 152 are positioned in radial alignment with the centroid 202 of the preestablished pattern 200 of the plurality of holes 186 in the inner member 150. At the second end 222 of the straight portion 218, a plurality of spacer members 232 are intermittently positioned between the cooling side 170 of the inner skin member 150 and the first surface 210 of the outer skin member 152. Each of the spacer members 232 are attached to an annular sliding member 234 in which the second end 222 of the straight portion 218 is slidably positioned. Connected to the spacer members 232 and the annular sliding member 234 is an outer conical or tapered portion 236 at a first end 238 and has a second end 240 corresponding to the outlet end portion 162 connected to the transition portion 196. The outer conical portion 236 is spaced from the inner conical portion 190 and forms a second cooling cavity 250. The spacing of the outer conical portion 236 from the inner conical portion 190 in this application is not necessarily evenly spaced along the second cooling cavity 250 between the first end 238 and the second end 240 of the outer conical portion 236. In this application, the spaced apart distance of the second cavity 250 is of a non-uniform spacing and the distance is smaller adjacent the second end 240. A plurality of non metering access holes 252 are positioned in rows 254 and along the circumference of the rows 254 at predetermined locations. The plurality of non metering access holes 252 are located closer to the first end 238 than to the second end 240 of the outer conical portion 236. The flow of cooling air from the air delivery system 12 is communicated to the second cooling cavity 250 through the plurality of non metering access holes 252. But, cooling airflow from the flow delivery system 12 is delivered to the first cooling cavity 216 and to the area between the plurality of spacer members 232 by the impingement cooling holes 224. A support member 256 is attached to the outer conical portion 236 and supports the outlet end portion 156 of the inner skin member 150 by way of the transition portion 196 and the outlet end portion 162 of the outer skin member 152 in a conventional manner.

Thus, the primary advantages of the improved combustor liner portions 24 is in the efficient use of the compressed cooling air. Since less cooling airflow per unit length of combustor wall, inner liner portion 40 and outer liner portion 42, is used there is a substantial reduction of CO emissions. The inner skin members 46 and outer skin member 152 of the inner liner and outer liner portions 40,42 respectively have a lower heat rejection to the gas turbine engine 10. The combination of the impingement and effusion cooling and the location of the plurality of impingement cooling holes 114,224 relative to the plurality of effusion cooling holes 80,186 allows the combustion chamber 24 to be subject to a very high heat flux as a result of high heat transfer rates conveyed by radiation and convection arising from the burning of fuel to be consistent with the design life expectancy of the combustor and its material properties. Thus, the improved impingement and effusion cooled combustor increases efficiency, reduces emissions and increases or maintains component life.

Other aspects, objects and advantages of this invention can be obtained from a study of the drawings, the disclosure and the appended claims.

We claim:

1. A combustor comprising:

an interior liner defining an inlet end portion and an outlet end portion being spaced apart by an axial portion, said interior liner defining a combustion side and a cooling side having a plurality of effusion holes defined therein extending between the combustion side and the cooling side, said plurality of effusion holes being formed in a preestablished pattern defining a centroid;

an exterior liner defining an inlet end portion and an outlet end portion being spaced apart by an axial portion, said exterior liner defining a first surface and a second surface having a plurality of impingement holes defined therein extending between the first surface and the second surface at an angle of about 90 degrees, said plurality of impingement holes being formed in a preestablished pattern;

said interior liner being spaced from said exterior liner forming a gallery therebetween, said gallery extending continually along said axial portion of said interior liner and said exterior liner; and at least a portion of said plurality of impingement holes in the exterior liner being positioned in radial alignment with the centroid of the preestablished pattern of the plurality of effusion holes in the interior liner.

2. The combustor of claim 1 wherein said portion of said plurality of impingement holes in the exterior liner are positioned in the axial portion.

3. The combustor of claim 1 wherein said plurality of effusion holes in the interior liner are at an angle between the combustion side and the cooling side.

4. The combustor of claim 3 wherein said angle extends from the inlet end portion toward the outlet end portion.

5. The combustor of claim 1 further including an inlet member being attached to the interior liner and forming a gallery therebetween.

6. The combustor of claim 5 wherein said interior liner has a plurality of passages therein being in communication with the gallery.

7. The combustor of claim 1 wherein said interior liner and said exterior liner has a cavity formed therebetween being in communication with the plurality of effusion holes in the interior liner and the plurality of impingement holes in the exterior liner.

8. The combustor of claim 1 wherein said interior liner and said exterior liner have a spacer member positioned therebetween defining a preestablished spacing therebetween forming a cavity therebetween.

9. The combustor of claim 1 wherein said interior liner and said exterior liner have a plurality of stiffening members positioned therebetween.

10. The combustor of claim 1 further including a transition portion connected to the outlet end portion and said exterior liner includes a straight portion defining a first end being attached to the inlet end portion and a second end, and a tapered portion having a first end and a second end connected to the transition portion, said second end of the straight portion and said first end of said tapered portion being slidably connected.

11. The combustor of claim 10 wherein said tapered portion has a dilution hole located therein.

12. The combustor of claim 11 wherein only said straight portion has the plurality of impingement holes therein.

13. The combustor of claim 1 further including a plurality of stiffener members attached to the interior liner.

14. The combustor of claim 13 wherein said plurality of stiffener members are attached to the cooling side of the interior liner.

15. The combustor of claim 1 wherein said axial portion of the interior liner includes a straight portion and a tapered portion and said plurality of effusion holes are located in the straight portion and the tapered portion.

16. The combustor of claim 15 wherein said axial portion of the exterior liner includes a straight portion and a tapered portion and said plurality of impingement holes are located in only the straight portion.

17. The combustor of claim 15 wherein said axial portion of the exterior liner includes a straight portion and a tapered portion and said plurality of impingement holes are located in each of the straight portion and the tapered portion.

18. The combustor of claim 16 wherein said tapered portion of the exterior liner has a plurality of non metering access holes defined therein.

19. The combustor of claim 18 wherein said tapered portion of the exterior liner includes a first end being adjacent the straight portion and a second end being adjacent the outlet end portion said plurality of non metering access holes being spaced more closely to the first end.

20. The combustor of claim 1 wherein said axial portion of the interior liner includes a straight portion being adjacent the inlet end portion and a tapered portion being adjacent the outlet end portion, said axial portion of the exterior liner includes a straight portion being adjacent the inlet end portion and a tapered portion being adjacent the outlet end portion, said straight portion of the interior liner and said straight portion of the exterior liner being spaced apart a preestablished distance forming a first cavity being generally uniform spaced apart distance along an axial distance of the first cavity.

21. The combustor of claim 20 wherein said tapered portion of the interior liner and said tapered portion of the exterior liner being spaced apart a preestablished distance forming a second cavity being of a non-uniform spaced apart distance along an axial distance of the second cavity.

22. The combustor of claim 21 wherein said non-uniform spaced apart distance is smaller adjacent the outlet end portion.

23. A combustor comprising:

an interior liner defining an inlet end portion and an outlet end portion being spaced apart by an axial portion, said interior liner defining a combustion side and a cooling side having a plurality of effusion holes defined therein extending between the combustion side and the cooling side, said plurality of effusion holes being formed in a preestablished pattern defining a centroid;

an exterior liner defining an inlet end portion and an outlet end portion being spaced apart by an axial portion, said exterior liner defining a first surface and a second surface having a pluraity of impingement holes defined therein extending between the first surface and the second surface at an angle of about 90 degrees, said plurality of impingement holes being formed in a preestablished pattern;

at least a portion of said plurality of impingement holes in the exterior liner being positioned in radial alignment with the centroid of the preestablished pattern of the plurality of effusion holes in the interior liner; and an inlet member being attached to the interior liner and forming a gallery therebetween.

* * * * *

UNITED STATES PATENT AND TRADEMARK OFFICE

CERTIFICATE OF CORRECTION

PATENT NO. : 5,758,504

DATED : June 2, 1998

INVENTOR(S) : Mario E. Abreu et al.

It is certified that error appears in the above-identified patent and that said Letters Patent is hereby corrected as shown below:

On the title page, item [75]:
Please correct the name of the second inventor to read as follows:

Virendra M. Sood

Signed and Sealed this

Eleventh Day of August 1998

Bruce Lehman

*Attest:*

BRUCE LEHMAN

*Attesting Officer*

*Commissioner of Patents and Trademarks*